United States Patent [19]

Mauranen

[11] 4,407,227

[45] Oct. 4, 1983

[54] SURFACE SIZING AND COATING APPARATUS FOR A PAPER WEB OF A PAPER MACHINE

[75] Inventor: Pekka Mauranen, Jyväskylä, Finland

[73] Assignee: Valmet Oy, Finland

[21] Appl. No.: 323,427

[22] Filed: Nov. 20, 1981

[30] Foreign Application Priority Data

Nov. 28, 1980 [FI] Finland ..... 803709

[51] Int. Cl.[3] ..... B05C 3/18

[52] U.S. Cl. ..... 118/642; 118/126; 118/412

[58] Field of Search ..... 118/126, 410, 411, 412, 118/407, 224, 642, 643, 227, 223, 314; 427/209, 211, 356

[56] References Cited

U.S. PATENT DOCUMENTS 2,645,201 7/1953 Muggleton ..... 118/227

3,124,476 3/1964 Park et al. ..... 118/642 X 4,108,110 8/1978 Berry ..... 118/412

*Primary Examiner*—John P. McIntosh

*Assistant Examiner*—Mary Beth Calligaris

*Attorney, Agent, or Firm*—Steinberg & Raskin

[57] ABSTRACT

Coating apparatus includes three coating rollers, in a closed group, forming two coating nips with each other. First coating supply apparatus is provided on the first coating roller, followed by knife or doctor coating apparatus. Second coating supply apparatus is provided on the second roller after the first nip, followed by knife or doctor coating apparatus. After the second roller, the paper web runs through a second nip formed by the second roller and a third coating roller. The coated web is released from the third coating roller and transferred to drying apparatus, for example. If necessary, heating apparatus is provided at the first and second coating rollers for drying the web and the coating agents by heat radiation without contact with the web.

14 Claims, 1 Drawing Figure

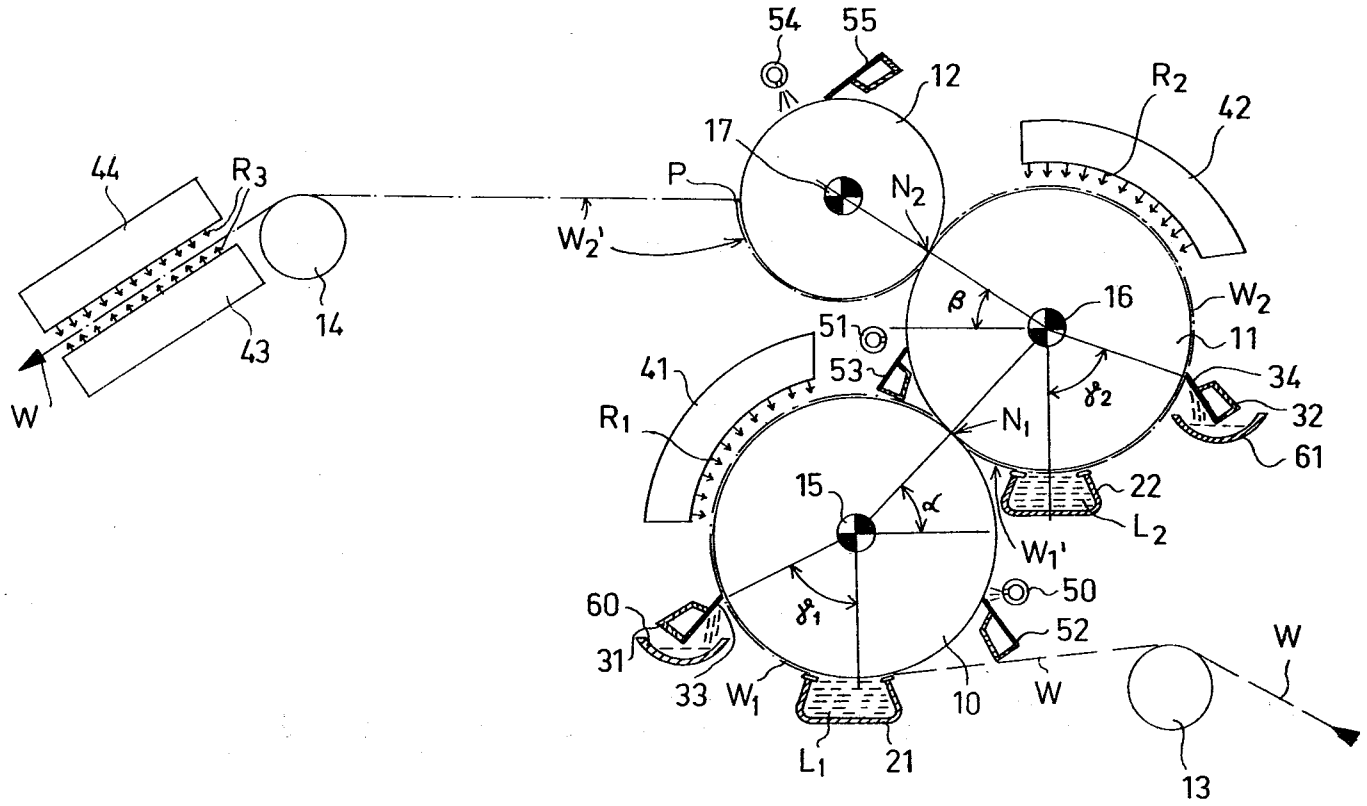
W
13
61
32
34
11
W2
42
R2
22
L2
16
γ2
50
52
W1'
N1
W
10
β
α
12
N2
21
55
53
51
15
γ1
L1
54
17
W1
33
P
41
R1
60
31
W2'
14
R3
43
44
W

SURFACE SIZING AND COATING APPARATUS FOR A PAPER WEB OF A PAPER MACHINE

BACKGROUND OF THE INVENTION

The present invention relates to surface sizing and coating apparatus for a paper web of a paper machine.

Known size presses comprise a coating pool through which a sizing agent, or other coating agent, is applied to the web. However, the web "wets" in the coating pool and its strength decreases. Furthermore, the web is without support and subjected to great hydrodynamic forces in the pool. This results in an increased risk of web breakage. It is known to use extruding apparatus or equivalent devices to supply the coating agent in connection with the coating roller. The coating agent supplied by such apparatus is leveled by knife or doctor coating apparatus. However, no pressing nips have been used in connection with such apparatus and the penetration of the coating agent into the web has remained poor.

The surface sizing and coating apparatus of the invention supports the web to be coated well during the application of the coating agent, which application is controlled. Thus, the speed of the web may be essentially increased, compared to previous speeds.

The surface sizing and/or coating apparatus of the invention for a paper web, or the like, comprises a plurality of coating rollers which form with each other one or more coating nips through which the web to be coated is arranged to pass.

The surface sizing of the paper web is usually made in an "on-machine" size press of the paper machine. The size press undertakes several different operations affecting the properties of paper and board.

As previously known, the paper web is run through the roller nip of the size press. The sizing agent is applied to the paper in the press by forming a pool or pools in front of the nip. The web gets wet in the pool and adsorbs sizing agent. The sizing agent is pressed into the web, due to hydrodynamic pressure, between the rollers of the size press.

As previously known, the oldest size press is the so-called vertical size press, in which the rollers are placed one on top of another and the paper runs horizontally between said rollers. In the known horizontal press, the rollers are in the same horizontal plane and the paper runs vertically between said rollers. The third known size press is the so-called oblique press, in which the rollers are placed one on top of another at an angle of about 45°.

The diameters of the rollers of size presses are important regarding the suitability of operation. In the known size presses, the diameters of nip rollers are fixed at about 800–1500 mm at operating speeds of 10 to 17 m/s. In known apparatus, it is attempted, by increasing the diameter of the rollers, to prevent splashing in the nip entrance pool, because this disturbs the even wetting of the paper web.

As previously known, rubber is most often used as the covering material of the rollers of size presses. Also known are presses in which the hard roller is metal and the soft roller is rubber. Thus, softer and harder pressing zones are used. Rollers with greater diameters are used at higher operating speeds. A good coating agent penetration is achieved not only by a sufficient wetting time, but also by a high pressing load of 40 to 50 kN/m.

The production of fine paper is shifting to large paper machines, which imposes great requirements on size presses. A poorly functioning size press decreases the productivity of the whole paper machine. The surface sizing and coating apparatus of the invention thus provides solutions which have been developed especially regarding high operating speeds.

Although the term "size press" is used herein, it must be understood that in this context the term "sizing agent" is used in a broad meaning, so that it also encompasses other known treatment agents for paper or board webs which are suitable for use in apparatus similar to that of the invention.

The size press of the invention is also suitable for use as a so-called "off-machine" coating machine.

A serious disadvantage of known size presses and similar coating machines is the splashing of the sizing agent or similar coating agent, which may even entirely spoil the web to be produced. The disadvantages caused by splashing are accentuated when the speeds of the size presses are increased. Splashing problems are thus especially accentuated in "on-machine" size presses.

A disadvantage of previously known coating apparatus based on the use of a coating pool is that the coating agent splashes from the pool to the surroundings, and even onto the web. Another disadvantage is that the web gets softer when passing through the pool, resulting in a decrease of the strength of the web. The risk of web breakages is then increased, because the weak web is subjected to large hydrodynamic forces when passing through the pool, and the web is not supported in the pool.

In order to avoid the aforementioned disadvantages, the apparatus of the invention starts from the previously known basis of applying the coating agent onto the web by known knife or doctor coating methods, and supplying the coating agent by known extruder apparatus, applicator rollers, or equivalent means. Of interest is an article entitled, "Bestrykning förbättrar tryck-papperets yta" by Ingrid Fineman in Kemisk Tidskrift 1979, No. 13, for example. This article, among others, presents various means for supplying the coating agent, and knife and doctor coating devices connected with them. However, pressing nips are not used in the known apparatus. It is well known that it is only possible to apply the coating agent to the surface zone of the web by knife or doctor coating, whereas the coating agent does not penetrate into the fiber structure of the web to a substantial extent. This partly explains the fact that in knife or doctor coating, the strength of the web does not essentially decrease due to the coating agent. However, in many cases it is very desirable that the coating agent penetrate into the fiber structure of the web, as deep as possible, so that the web becomes, among other things, as strong as possible.

SUMMARY OF THE INVENTION

The principal object of the invention is to provide surface sizing and coating apparatus in which the disadvantages of known apparatus are avoided.

An object of the invention is to provide surface sizing and coating apparatus in which the operating speed of the web may be considerably increased from what it has previously been, without disturbing web breakages.

Another object of the invention is to provide surface sizing and coating apparatus in which the coating agent may be made to penetrate deeper than before into the fiber structure of the web to be treated.

Still another object of the invention is to provide a size press suitable for use at higher web speeds than heretofore.

Yet another object of the invention is to provide a size press "on-machine" apparatus of a paper machine, which apparatus operates at web speeds as high as those of the paper machine.

In order to achieve the aforedescribed objects, and other objects which will become apparent, the apparatus of the invention comprises first coating supply apparatus on the first coating roller in the running direction of the web, followed by knife or doctor coating apparatus on said first roller. The first coating roller forms a first pressing nip with a second coating roller. Second coating supply apparatus is provided on the second coating roller, followed by knife or doctor coating apparatus on the second roller. A third coating roller forms a second coating nip with the second coating roller.

Only the untreated side of the web touches the first coating roller in the running direction of the web, in the apparatus of the invention. This provides the advantage that, after the first coating nip, the web naturally follows the second coating roller, due to adhesion caused by the coating agent and is released from the first roller, which partly decreases the risk of web breakages.

An essential advantage of the invention is also the fact that the paper web is supported by the surface of the rollers during the entire coating process.

BRIEF DESCRIPTION OF THE DRAWINGS

For a fuller understanding of the invention, reference is had to the following description, taken in connection with the accompanying drawings, in which the single FIGURE is a schematic side elevation of an embodiment of the coating apparatus of the invention.

DESCRIPTION OF PREFERRED EMBODIMENTS

The web W to be coated enters the coating apparatus via an entrance by $W_{in}$ and leaves the apparatus, after being coated, via an exit $W_{out}$.

The coating apparatus shown in the FIGURE comprises three coating rollers 10, 11 and 12, which form coating nips $N_1$ and $N_2$ with each other. The coating rollers 10, 11 and 12 have smooth surfaces, for example. The roller 10 has a hard surface, for example, of metal, the central roller 11 has a soft surface, for example, covered by rubber, and the third roller 12 has a hard surface, for example, of metal. Alternatively, the rollers 10 and 12 may have soft surfaces, for example, covered by rubber, and the roller 11 may have a hard surface, for example, of metal. Thus, in both coating nips $N_1$ and $N_2$ a soft-surface roller and a hard-surface roller face each other. This is advantageous for reasons which will become apparent hereinafter.

Each of the rollers 10, 11 and 12 is provided with its own drive 15, 16 and 17, respectively. The coating apparatus shown in the FIGURE is preferably a so-called "on-machine" apparatus, in which case the rollers 10, 11 and 12 are operated at the web speed of the paper machine. It must be also noted that the coating apparatus of the invention may also be used as a so-called "off-machine" apparatus.

Known apparatus 21 for supplying a coating agent $L_1$ such as, for example, a coating pigment, coating paste or sizing agent, is provided beneath the first coating roller 10. As the web runs past the apparatus 21, carried by the roller 10, its outer surface becomes treated by the coating agent. The web, thus treated, shown by an interrupted dotted line $W_1$, thereafter moves to knife or doctor coating apparatus 31. The apparatus 31 has a blade which scrapes off the extra coating and levels the coating. The web $W_1$ then runs past heating apparatus 41 which directs heat radiation $R_1$ to the coating, aiming at controlling the coating process. After the heating apparatus 41, the web $W_1$ moves into the nip $N_1$, formed by the first and second rollers 10 and 11, where the coating agent $L_1$ is pressed into the web in a known manner.

A second coating supply apparatus 22 is provided, after the nip $N_1$, at the roller 11. The second coating supply apparatus 22 treats the second, non-treated, surface of the web $W_1$ to another coating agent $L_2$. The web, thus treated, is led to knife or doctor coating apparatus 32 provided at the roller 11. The apparatus 32 has a blade 34 which scrapes off the extra coating and levels the last-supplied coating even. The treated web $W_2$, marked by two dots and an interrupted line, then runs past heating apparatus 42 which directs heat radiation $R_2$ to the last-coated outer surface of said web. Thereafter, the web $W_2$ runs into the second pressing nip $N_2$, formed by the rollers 11 and 12, in which especially the coating agent $L_2$, supplied by the apparatus 22, is pressed into the fiber structure of said web.

The web $W_2'$, thus treated, is released from the hard surface roller 12 at a point P and is led via a guide roller 14 past heating apparatus 43 and 44. The heating apparatus 43 and 44 subjects the web $W_2'$ to heat radiation $R_3$ from both sides, in order to dry the coating agents $L_1$ and $L_2$. Thereafter, the web $W_{out}$ moves to further known treatment stages.

The FIGURE shows the heating or drying apparatus 41, 42, 43 and 44 which direct heat radiation into the web, without touching or making contact with the web. As hereinbefore stated, the heating apparatus 41 and 42 is positioned at the rollers 10 and 11, respectively, and enable the coating process and the adhesion of the web to the surfaces of the rollers to be controlled.

The coating rollers 10, 11 and 12 may be cooled, so that the water vapor existing in the surrounding air is condensed on the surfaces of said rollers, and the water on said surfaces is transferred to the web and increases its moisture level, thus facilitating the releasing of the web from the roller surfaces. Water may also be sprayed onto the surfaces of the rollers 10, 11 and 12 from specially arranged spraying pipes 50, 51 and 54. The rollers 10, 11 and 12 are preferably provided with doctors 52, 53 and 55 for keeping their surfaces clean.

An important advantage of the invention is that the surface sizing or other surface treatment of paper may be accomplished at a considerably higher speed, for example, at a speed of about 20 m/s, whereas in previously known surface sizing presses only speeds of the order of about 13 m/s are feasible. This is achieved by well-supporting the paper web in the apparatus of the invention during the application of the sizing agent or other corresponding coating agent, and by controlling the application of the sizing agent. The penetration of the sizing agent, or other coating agent, into the fiber structure of the paper may be controlled by adjusting the linear load of the pressing nips $N_1$ and $N_2$ of the coating apparatus, and can be made deep enough.

In the FIGURE, the coating rollers 10, 11 and 12 are placed one on top of another, so that a plane through the axes of the first and second coating rollers 10 and 11 forms a rather large angle $\alpha$ with the horizontal plane. The angle $\alpha$ is, for example, 30° to 60°, preferably about 45°. Correspondingly, a plane through the axes of the second and third coating rollers 11 and 12 forms an angle $\beta$ with the horizontal plane. The angle $\beta$ is, for example, about 20° to 60°, preferably 30°.

The first coating apparatus 21 on the first coating roller 10 is preferably placed so that said coating supply apparatus is in a vertical plane through the axis of said roller, and the angle $\gamma_1$ from the central plane of said coating supply apparatus to the first knife or doctor coating apparatus is about 50° to 90°, preferably about 70°. Correspondingly, the second coating supply apparatus 22 on the roller 11 is preferably placed in a vertical plane through the axis of said roller, so that the angle $\gamma_2$ from the central plane of said coating supply apparatus to the second knife or doctor coating apparatus 32, 34 is preferably as great as the angle $\gamma_1$. In this way, the coating apparatus has an advantageous total geometry around the relatively large diameter rollers, in which all necessary apparatus may be disposed without difficulty.

In the FIGURE, the entrance of the $W_{in}$ into the coating apparatus is essentially horizontal, and, correspondingly, the exit of the web from the roller at the point P is also essentially horizontal.

The invention is by no means restricted to the aforementioned details which are described only as examples; they may vary within the framework of the invention, as defined in the following claims.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. Surface sizing and coating apparatus for a paper web of a paper machine having first, second and third coating rollers positioned to form first and second coating nips with each other through which the web to be coated is arranged to pass, said first and second coating rollers forming a first coating nip and said second and third coating rollers forming a second coating nip, said web having spaced opposite surfaces, said surface sizing and coating apparatus comprising first coating supply means on said first coating roller for supplying a coating directly on a surface of said web;

first doctor coating means on said first roller disposed after said first coating supply means in the running direction of said web, said first coating nip being disposed after said first doctor coating means in said running direction;

second coating supply means on said second coating roller for supplying a coating directly on the opposite surface of said web; and second doctor coating means on said second roller disposed after said second coating supply means in the running direction of said web, said second coating nip being disposed after said second doctor coating means in said running direction.

2. Surface sizing and coating apparatus as claimed in claim 1, wherein said first coating supply means is placed beneath said first coating roller substantially in a vertical plane through the axis of said first roller and said second coating supply means is placed beneath said second coating roller in a vertical plane through the axis of said second roller.

3. Surface sizing and coating apparatus as claimed in claim 2, wherein said second coating roller is positioned on top of said first coating roller in a manner whereby a plane through the axes of said first and second rollers forms a first angle of about 30° to 60° with a horizontal plane and said third coating roller is positioned on top of said second coating roller in a manner whereby a plane through the axes of said second and third rollers forms a second angle of about 20° to 60° with a horizontal plane.

4. Surface sizing and coating appartus as claimed in claim 3, wherein said first angle is approximately 45° and said second angle is approximately 30°.

5. Surface sizing and coating apparatus as claimed in claim 1, further comprising first heating means in operative proximity with said first coating roller in an area between said first doctor coating means and said first coating nip for directing heat radiation into said web treated by said first coating supply means without said first heating means touching said web.

6. Surface sizing and coating apparatus as claimed in claim 5, further comprising second heating means in operative proximity with said second coating roller in an area between said second doctor coating means and said second coating nip for directing heat radiation into said web treated by said second coating supply means without said second heating means touching said web.

7. Surface and sizing coating apparatus as claimed in claim 1, wherein said web enters onto said first coating roller substantially horizontally and leaves said third coating roller substantially horizontally.

8. Surface sizing and coating apparatus as claimed in claim 1, further comprising a plurality of drive means for driving each of said coating rollers individually.

9. Surface sizing and coating apparatus as claimed in claim 1, wherein each of said coating rollers has a smooth surface, one of said rollers has a soft surface and each of the other rollers has a hard surface.

10. Surface sizing and coating apparatus as claimed in claim 9, wherein said second coating roller has a soft surface and each of said first and third coating rollers has a hard surface whereby at each of said first and second coating nips a soft-surface roller and a hard-surface roller face each other.

11. Surface sizing and coating apparatus as claimed in claim 10, wherein said second coating roller has a rubber surface and each of said first and third coating rollers has a metal surface.

12. Surface sizing and coating apparatus as claimed in claim 1, wherein each of said coating rollers has a smooth surface, one of said rollers has a hard surface and each of the other rollers has a soft surface.

13. Surface sizing and coating apparatus as claimed in claim 12, wherein said second coating roller has a hard surface and each of said first and third coating rollers has a soft surface whereby at each of said first and second coating nips a hard-surface roller and a soft-surface roller face each other.

14. Surface sizing and coating appartus as claimed in claim 13, wherein said second coating roller has a metal surface and each of said first and third coating rollers has a rubber surface.

* * * * *